US006645622B2

(12) United States Patent
Yamane

(10) Patent No.: US 6,645,622 B2
(45) Date of Patent: Nov. 11, 2003

(54) BIODEGRADABLE FIBER AND PROCESS FOR PREPARING THE SAME

(75) Inventor: Hideki Yamane, Moriyama (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 10/165,935

(22) Filed: Jun. 10, 2002

(65) Prior Publication Data

US 2003/0088052 A1 May 8, 2003

(30) Foreign Application Priority Data

Jun. 11, 2001 (JP) ..... 2001-175239

(51) Int. Cl.[7] ..... D02G 3/00; D01D 5/12

(52) U.S. Cl. ..... 428/364; 528/361; 525/437; 525/450; 264/210.5; 264/210.7; 264/211.14; 264/211.17

(58) Field of Search ..... 528/361; 525/437, 525/450; 428/364; 264/210.5, 210.7, 211.14, 211.17

(56) References Cited

FOREIGN PATENT DOCUMENTS

EP 0 104 731 4/1984

OTHER PUBLICATIONS

Database WPI, Section Ch, Week 199921, Derwent Publications Ltd., London, GB; AN 1996–027156, XP002213295 & JP 02 883809 B 9Chuko Kasei Kogyo KK), Apr. 19, 1999.

Patent Abstracts of Japan, vol. 1996, No. 12, Dec. 26, 1996 & JP 08 218216 A 9Unitika Ltd.; Chikyu Kankyo Sangyo Gijutsu Kenkyu Kiko), Aug. 27, 1996.

*Primary Examiner*—Samuel A. Acquah
(74) *Attorney, Agent, or Firm*—Kenyon & Kenyon

(57) ABSTRACT

The object of the present invention is to provide melt-extrusion conditions and drawing process which enable to carry out stable and smooth fiber spinning of polyester produced by microorganisms, particularly P(3HB-CO-3HH) which conventionally had problems in spinning stability, as well as P(3HB) and P(3HB-CO-3HV). Another object of the present invention is to obtain filament having particular properties according to the process. The process comprises extruding a thermoplastic polymer from a melt-extruder, then rapidly cooling the same to at most the glass transition point of the polymer immediately after the extrusion to prevent the filament from blocking, and carrying out partial crystallization of the same rapidly at not less than the glass transition point.

10 Claims, 2 Drawing Sheets

BIODEGRADABLE FIBER AND PROCESS FOR PREPARING THE SAME

BACKGROUND OF THE INVENTION

The present invention relates to a method for processing fibers. More specifically, the present invention relates to a process for preparing biodegradable fibers useful as a fiber product for agriculture, civil engineering and fishing industry, and biodegradable fiber obtained by the process.

There is a growing social awareness that a large amount of plastics are discarded into natural environment to cause environmental destruction. This recognition has promoted development of biodegradable plastics which can be decomposed and reduced into carbon dioxide and water in a natural environment. By preparation methods, presently known biodegradable plastics can be classified into chemically synthesized materials such as polylactic acid and polybutylene succinate, natural product containing materials such as starch, cellulose, and blended materials of these and other degradable plastics, and polyester produced by microorganisms such as poly-3-hydroxybutylates and poly-3-hydroxyalkanoates.

The polyester produced by microorganisms is a storage substance accumulated in the body of microorganisms. This is a polymer substance which serves as an energy source for microorganisms in starvation.

In natural world, there are many microorganisms which degrade polyester produced by microorganisms. The polyester produced by microorganisms has excellent feature that it can be degraded fast by biological methods in natural environment such as soil, river, lakes, seawater, activated sludge or compost. Another excellent feature of the polyester produced by microorganisms is that it has thermoplasticity just like general plastics and can be processed into various forms according to usual processing methods of plastics. In this respect, the polyester produced by microorganisms is a polymer far more useful than natural products such as starch and cellulose.

Polyhydroxyalkanoate, one of the typical polyesters produced by microorganisms, is an aliphatic polyester biosynthesized by an internal enzyme of microorganisms, which has limited number of structures because of the specificity of the enzyme. The most known polyester produced by microorganisms is poly-3-hydroxybutylate (hereinafter referred to as P(3HB)) represented by the following structural formula:

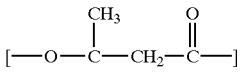

However, the polymer is hard and brittle. Though commercial production of the polymer was once undertaken, the polymer failed to become widespread because its properties were unsatisfactory. In order to overcome this defect, ICI. has tried some culture methods and succeeded in the copolymerization of the material (EP 52459 and EP 69497). This is a method of fermentation synthesis of a random copolymer (hereinafter referred to as P(3HB-CO-3HV) comprising two monomer units, that is, 3-hydroxybutylate (3HB) and 3-hydroxyvalylate (3HV) in the coexistence of glucose and propionic acid, which are inherently used as carbon source in incubating microorganisms which biosynthesize P(3HB). The copolymer has become commercially available by the trade name "BIOPOL". The structure of the copolymer is as follows:

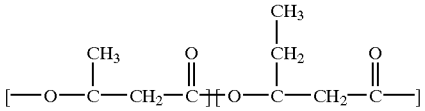

On the other hand, microorganisms are isolated from nature, which biosynthesize a random copolymer (hereinafter referred to as P(3HB-CO-3HH) comprising two monomer units, that is, 3-hydroxybutylate (3HB) and 3-hydroxyhexanoate (3HH)(Japanese Patent No. 2777757). The structure of the copolymer is as follows:

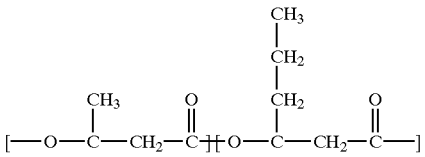

Properties of the above copolymers P(3HB), P(3HB-CO-3HV) and P(3HB-CO-3HH) are made obvious in the research paper by Doi et al, "Macromolecules, Vol. 28, No. 14, 1995". For example, P(3HB) is hard and brittle as mentioned above, and it is a homopolymer which has a homogeneous properties. As to P(3HB-CO-3HV), no significant change is observed in crystallinity though its properties depend on the composition of 3HV, and there is no significant change in elasticity even if the composition of 3HV is increased. That is, it does not happen that elongation is well over 100%. This is because 3HB and 3HV have structural difference in only one methylene group in the side chain. On the other hand, crystallinity of P(3HB-CO-3HH) decreases rapidly and significant change of properties is observed when the composition of 3HH is increased. This is because 3HB and 3HH have structural difference in two methylene groups in the side chain. Comparison of properties of P(3HB-CO-3HV) and P(3HB-CO-3HH) is shown in Tables 1 and 2.

TABLE 1

Properties of P(3HB-CO-3HV) (BIOPOL)

| | Composition of 3HV (% by mole) | | |
|---|---|---|---|
| Characteristics | 0 | 10 | 20 |
| Crystallization degree (%) | 60 ± 5 | 55 ± 5 | 52 ± 5 |
| Melting point (° C.) | 180 | 140 | 130 |
| Tensile strength (MPa) | 40 | 25 | 20 |
| Elongation at break (%) | 8 | 20 | 50 |

TABLE 2

Properties of P(3HB-CO-3HH)

| | Composition of 3HH (% by mole) | | | | |
|---|---|---|---|---|---|
| Characteristics | 0 | 10 | 14 | 17 | 31 |
| Crystallization degree (%) | 60 ± 5 | 44 ± 5 | 40 ± 5 | 38 ± 5 | 24 ± 5 |
| Melting point (° C.) | 180 | 129 | 123 | 119 | 73 |
| Tensile strength (MPa) | 43 | 21 | 23 | 20 | 6 |
| Elongation at break (%) | 5 | 400 | 760 | 800< | 800< |

In this way, it is obvious that properties of polyesters produced by microorganisms can be changed when copolymerized and that the structure of units also results in significant difference in properties.

Polyesters produced by microorganisms are one of the aliphatic polyesters having thermoplasticity, which can be molded just like other general plastics according to various processing methods. For example, P(3HB-CO-3HV) is processed in various ways and sold by the trade name "BIOPOL" Methods of processing P(3HB-CO-3HH) are disclosed in Japanese Unexamined Patent Publication Nos. 508424/1997, 508426/1997 and 128920/1998. However, as to the process for spinning P(3HB-CO-3HH) fibers, Japanese Unexamined Patent Publication No. 508424/1997 only discloses a general fiber spinning method and an example to prepare staple fibers having a length of 1.3 to 15 cm by jetting the fibers into rapid air stream from the nozzle of the extruder. And there is no report on the process for preparing P(3HB-CO-3HH) drawn filament.

Japanese Examined Patent Publication No. 63056/1990 discloses a method of spinning polyester produced by microorganisms which comprises holding P(3HB) or P(3HB-CO-3HV) at temperature ranging from the melting point −40° C. to the melting point, holding the same at not more than 100° C. for 1 to 120 seconds, and drawing the same 1.2-fold. In addition, Japanese Examined Patent Publication No. 63055/1990 discloses a method which comprises cooling melt-molded articles in water bath to carry out partial crystallization, and drawing drawable partially-crystallized undrawn filament by utilizing the peripheral speed ratio of rollers in a temperature range of the maximum crystallization temperature −30° C. to the maximum crystallization temperature +30° C. Furthermore, there are reports on methods further comprising pre-heating step before drawing, and heating step after drawing so that the rapid cooling step and the drawing step are carried out separately (Japanese Patent Publication Nos. 2815260, 2883809 and 2892964). However, such spinning methods had a problem that solidification does not proceed when spinning of P(3HB-CO-3HH) is intended, and end breakage or adhesion of fibers to the water bath guide is caused, resulting in unsuccessful fiber spinning.

Referring now to FIG. 1, a melt extrudate 2 is extruded from a die 1 of the melt extruder and cooled in a water bath 3 through guides 4 and 5 to obtain fixed monofilament 6 in which crystallizaiton is partially progressed. Subsequently, the fixed monofilament 6 is contacted with a heated pin 8 through a taken up roll 7 and heated on a heated plate 9. Thereafter, the filament is rolled on a reel 10 through the taken up roll 7.

An object of the present invention is to provide melt-extrusion conditions and drawing process which achieve stable fiber spinning of polyester produced by microorganisms which conventionally had problems in spinning stability, and smooth spinning of P(3HB-CO-3HH) as well as P(3HB) and P(3HB-CO-3HV) to obtain filament having particular properties.

SUMMARY OF THE INVENTION

As a result of intensive studies on the cause of unsuccessful fiber spinning of P(3HB-CO-3HH) in conventional methods, it became apparent that P(3HB-CO-3HH) did not have high crystallinity as P(3HB) or P(3HB-CO-3HV). It also became clear that it was necessary to carry out drawing by controlling melt viscosity of filament, solidifying the filament surface rapidly, and carrying out partial crystallization of the polymer rapidly, because crystallization speed of P(3HB-CO-3HH) was lower than that of P(3HB) or P(3HB-CO-3HV). Consequently, steps has been found for stable fiber spinning of P(3HB-CO-3HH), in which the surface of melted filament extruded from the melt extruder is cooled to at most the glass transition point to solidify the surface and the filament is prevented from blocking to carry out partial crystallization rapidly at not less than the glass transition point. It has also been found that the obtained pre-drawn filament can be drawn further, is capable of inhibiting growth of sphaerite and has sufficient elasticity and strength.

That is, the present invention relates to a process for producing a biodegradable fiber which comprises steps of: preparing a melted filament by extruding a thermoplastic polymer comprising polyhydroxyalkanoate from a melt-extruder; rapidly cooling the filament to at most the glass transition point of the thermoplastic polymer; passing the filament through a hot water bath adjusted to a water temperature of at least the glass transition point; and drawing the same.

It is preferable that the rapidly cooling step is a step in which the filament is rapidly cooled by passing the filament through a cooling cylinder provided below an outlet of the melt extruder to lower the temperature of at least the surface of the melted filament to at most the glass transition point.

It is preferable that the polyhydroxyalkanoate is a copolymer containing at least 3-hydroxybutylate and 3-hydroxyhexanoate.

It is preferable that the water temperature of the hot water bath is from at most the glass transition point to at least the maximum crystallization temperature +20° C. of the thermoplastic polymer, and that the filament is partially crystallized by passing the filament through the water bath adjusted to the temperature.

The temperature of the drawing step is preferably in the range of the maximum crystallization temperature of the thermoplastic polymer −20° C. to the maximum crystallization temperature of the thermoplastic polymer +20° C.

It is preferable that the drawing step is carried out at a drawing ratio of 2 to 8-fold.

It is preferable that further drawing is carried out for 1 to 3 times under the same condition at a drawing ratio of 1.2 to 4-fold after the drawing step.

It is preferable that the process further comprises a heat treating step after the drawing step.

It is preferable that the heat treating step is carried out in a temperature range of the maximum crystallization temperature of the thermoplastic polymer −20° C. to the maximum crystallization temperature of the thermoplastic polymer +2020 C.

The present invention also relates to biodegradable fiber obtained by the process.

DETAILED DESCRIPTION

Figure 1:
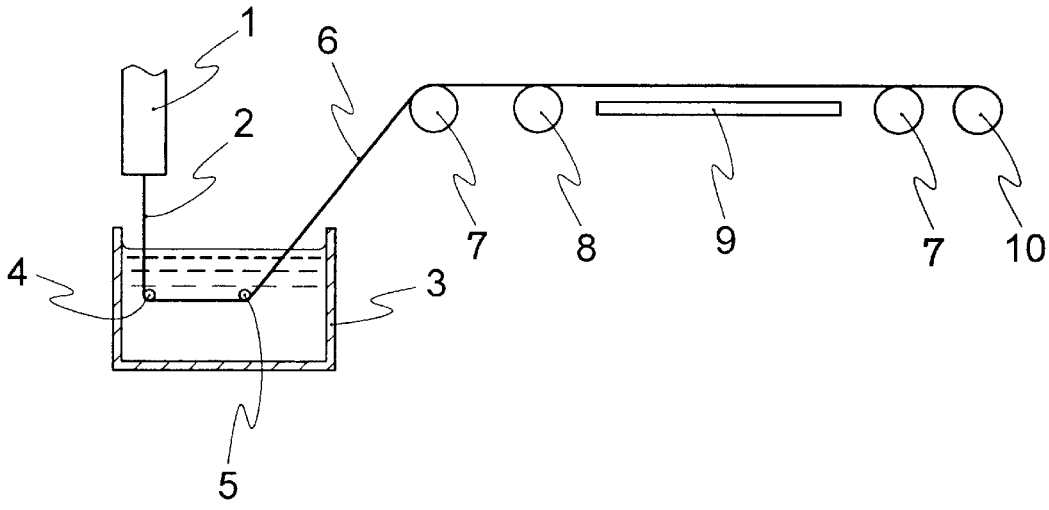
FIG. 1 is a schematic view of a conventional fiber spinning machine (Japanese Examined Patent Publication No. 63055/1990).

The present invention relates to a process for producing a biodegradable fiber which comprises steps of: preparing a melted filament by extruding a thermoplastic polymer comprising polyhydroxyalkanoate from a melt-extruder; rapidly cooling the filament to at most the glass transition point of the thermoplastic polymer; passing the filament through a hot water bath adjusted to a water temperature of at least the glass transition point; drawing the same; and heat-treating the same.

The thermoplastic polymer of the present invention comprises polyhydroxyalkanoate which is polyester produced by microorganisms. The thermoplastic polymer of the present invention may contain polyhydroxyalkanoate. Examples of polyhydroxyalkanoate are not particularly limited, but include homopolymers such as 3HB, 3HH, 3HV, 3-hydroxyoctanoate (hereinafter referred to as 3HO), 3-hydroxydecanoate (hereinafter referred to as 3HD), 4-hydroxybutylate (hereinafter referred to as 4HB) and 3-hydroxypropionate (hereinafter referred to as 3HP) and copolymers thereof. Among these, P(3HB-CO-3HH) which was difficult to spin in conventional methods, 3HB, 3HH and copolymers containing other hydroxyalkanoates as a third component are preferable.

The content of 3HB in the copolymer is preferably 98 to 80% by mole, and the content of 3HH is preferably 2 to 20% by mole. When the content of 3HH is less than 2% by mole, there is a tendency that crystallization speed is high and fiber having high strength can be obtained, but the obtained fiber is hard and lacks flexibility. When the content of 3HH is more than 20% by mole, there is a tendency that extremely flexible fiber can be obtained but crystallization speed is extremely low, and stable fiber spinning is difficult.

The melt extruder of the present invention may be any of commonly used extruders. Melted filament is prepared by extruding the thermoplastic polymer from the melt extruder. Temperature of the cylinder or the exit of the die is adjusted to maintain an appropriate melt viscosity of the polymer depending on the weight average molecular weight of P(3HB-CO-3HH) which is a thermoplastic polymer and the amount of 3 HH. Further, it is preferable that the melted filament has such a melt viscosity that the filament has a tension suitable to carry out the drawing to some degree in the hot water bath and that crystallization can proceed.

The filament is rapidly cooled to at most the grass transition point of the thermoplastic polymer. It is preferable that the temperature is rapidly lowered to at most 10° C. lower than the glass transition point. When the temperature is higher than the glass transition point of the thermoplastic resin, fiber spinning in the water bath tends to be unstable and there are many cases where taking-up of fiber becomes difficult since end breakage or the like is caused.

Herein, the rapid cooling of the filament to at most the glass transition point of the thermoplastic polymer includes rapid cooling of at least the surface of the filament to at most the glass transition point of the thermoplastic polymer. For example, even if the core of the melted filament is over the glass transition point, it is sufficient when at least the surface of the melted filament is at most the glass transition point.

In particular, it is preferable that the filament is rapidly cooled by passing the filament through a cooling cylinder provided below an outlet of the melt extruder to lower the temperature of at least the surface of the melted filament to at most the glass transition point in the rapidly cooling step.

Examples of rapidly cooling methods include a method to contact the filament with cooled air or a method to pass the filament through refrigerant. Among these, it is more preferable to cool the filament with cooled air by using a cooling cylinder or the like to lower the temperature of at least the surface of the melted filament to at most the glass transition point.

Secondly, the rapidly cooled filament is passed through a hot water bath adjusted to a water temperature of at least the glass transition point.

It is preferable that the water temperature of the hot water bath is from at least the glass transition point to at most the maximum crystallization temperature +20° C. of the thermoplastic polymer, and that the filament is partially crystallized by passing the filament through the water bath adjusted to the temperature.

The water temperature of the hot water bath must be at least the glass transition temperature of the thermoplastic polymer though different thermoplastic polymers have different maximum crystallization temperatures and glass transition points. More preferably, the temperature is at least the glass transition point +10° C. Preferably, the temperature is at most the maximum crystallization temperature +20° C. More preferably, the temperature is at most the maximum crystallization temperature +10° C. Herein, the maximum crystallization temperature means the temperature representing the maximum exothermic peak which appears along with the crystallization of the polymer in a DSC temperature increase analysis.

In this temperature range, crystallization can proceed with maintaining a high melt viscosity and the filament can be partially crystallized. When the temperature is out of this range, since crystallization speed becomes extremely low, fiber spinning cannot be kept stable, and in addition, it becomes difficult to carry out the subsequent drawing step itself. The object of the step is to crystallize the filament partially by passing the filament through a hot water bath. However, it is also possible to carry out some degree of drawing in this step by controlling peripheral speeds of taken up rolls provided below the outlet of the hot water bath. But the drawing in the water bath is carried out while crystallization is not yet in progress, and therefore troubles such as end breakage may be caused when the drawing is carried out at high drawing ratio in this step. Accordingly, the drawing ratio is preferably from 1.5 to 2-fold or drawing may not be carried out.

The pre-drawn filament obtained in the step of passing the filament through a hot water bath adjusted to water temperature of at least the glass transition point is a rubber elastic body whose crystallization is in partial progress. To reinforce the filament, it is necessary to carry out further crystallization and also to orient crystals. Therefore, temperature of the pre-drawn filament is controlled with hot air to draw the filament in the following drawing step. Pre-drawn filament may be pre-heated before the subsequent drawing step.

The temperature of the drawing step is preferably in the range of the maximum crystallization temperature +20° C. to the maximum crystallization temperature +20° C., more preferably in the range of the maximum crystallization temperature −10° C. to the maximum crystallization temperature +10° C. When the temperature is lower than the maximum crystallization temperature −20° C., there is a tendency that crystallization speed is low and stable fiber spinning is difficult. When the temperature is higher than the maximum crystallization temperature +20° C., there is also a tendency that crystallization speed is low and stable fiber spinning is difficult.

In this case, the drawing ratio is preferably in the range of 2 to 8-fold, more preferably 2 to 4-fold. When the drawing ratio is less than 2-fold, orientation of crystals is insufficient and the filament to be obtained cannot be regarded as a drawn filament. When such filament which is insufficient in orientation of crystals is left at room temperature, there is a tendency that sphaerite easily grows and successive drawing becomes difficult. When the drawing ratio is more than 8-fold, there is an unfavorable tendency that end breakage is caused and fiber spinning stability is decreased.

It is preferable to carry out further drawing after the drawing step for 1 to 3 times under the same condition at a drawing ratio of 1.2 to 4-fold. Herein, "the same condition" means that the temperature condition is the same as that of the drawing step. The drawing ratio in this case is preferably 1.2 to 4-fold. It is preferable to carry out the drawing for 1 to 3 times. For example, when progress of crystallization is sufficient, the drawing may be carried out only for 1 time. When progress of crystallization is not sufficient, it is preferable to repeat the drawing for several times at a low daring ratio. It is preferable to carry out the drawing in the vicinity of the maximum crystallization temperature of the thermoplastic polymer, more specifically, within the temperature range of the maximum crystallization temperature −20° C. to the maximum crystallization temperature +20° C. When the temperature is far off the range, crystallization does not proceed and drawing becomes difficult, resulting in a tendency that fiber spinning is unstable.

The subsequent heat treating step may be any usual heat treating method. Crystallization is further promoted in this step. The temperature of the heating step is adjusted to preferably the temperature range of the maximum crystallization temperature of the thermoplastic polymer −20° C. to the maximum crystallization temperature of the thermoplastic polymer +20° C., more preferably the temperature range of the maximum crystallization temperature of the thermoplastic polymer −10° C. to the maximum crystallization temperature of the thermoplastic polymer +10° C. In case of P(3HB-CO-3HH), since its crystallization degree is not high and crystallization speed is low originally, it is preferable to promote crystallization by adjusting the temperature to about the maximum crystallization temperature and to develop orientation of molecules in the amorphous part to increase the tensile strength.

Further, though nucleating agent used for promoting crystallization is not necessary in the present invention, it may be added in order to adjust the crystallization speed. The present invention does not specify the kind or the amount of the nucleating agent, but the nucleating agent may be added in such an amount as used in general processing methods.

In the preparation process of the present invention, the pre-drawn filament passed though the hot water bath exhibits characteristics of rubber elastic body, and there is a tendency that it does not grow into three-dimensional sphaerite or does not exhibit brittleness even if left at room temperature for some time. Therefore, it is possible to take up the filament in this state and then carry out the drawing. That is, the inventive preparation process does not require procedures such as repeating a series of steps of fiber spinning, drawing and heat treating, or separating spinning step from drawing step to pre-heat the filament before drawing as conventional fiber spinning methods. According to the present invention, it is not necessary to heat the filament to at least 100° C. once it is drawn, but the filament can be drawn at not less than the glass transition point (about 0° C.) and the drawing can be repeated if necessary.

The present invention succeeded in preparing drawn filament of P(3HB-CO-3HH). Such technique is suitable for spinning not only P(3HB-CO-3HH) but also polyhydroxyalkanoates. In particular, this is an effective means for spinning polyhydroxyalcanoates containing units having a large number of methylene groups in the side chain. This is because thermoplastic polymers containing units having a large number of methylene groups in the side chain has low crystallization speed and tend to have slower progress of solidification. Thermoplastic polymers containing units having a small number of methylene groups in the side chain, such as P(3HB) and P(3HB-CO-3HV) has large crystallization degree and high crystallization speed, and therefore are unlikely to cause blocking. In the fiber spinning process of P(3HB-CO-3HH), a means to overcome the problem of blocking has been required, and the problem has been solved by the present invention.

The drawn filament of P(3HB-CO-3HH) obtained by the preparation process of the present invention exhibits characteristics corresponding to properties of P(3HB-CO-3HH) and different from characteristics of drawn filament of P(3HB) or P(3HB-CO-3HV). Unlike other drawn filaments which has extremely high strength and elasticity, the drawn filament of P(3HB-CO-3HH) has moderate strength, elasticity and flexibility. This seems to originate in the fact that the proportion of the part of oriented polymer molecules is higher than that of the oriented crystallized part. Such characteristics are not observed in drawn filament of P(3HB) or P(3HB-CO-3HV), which are suitable for knit articles such as net.

EXAMPLE

Hereinafter, the present invention is explained in more detail based on Examples, but the present invention is not limited thereto.

Figure 2:
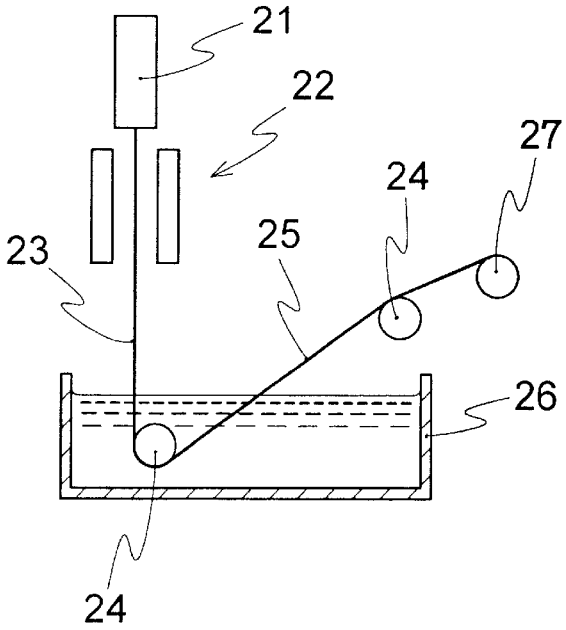
FIG. 2 is a schematic view of an extruder and hot water bath apparatus for crystallization of the present invention.
Figure 3:
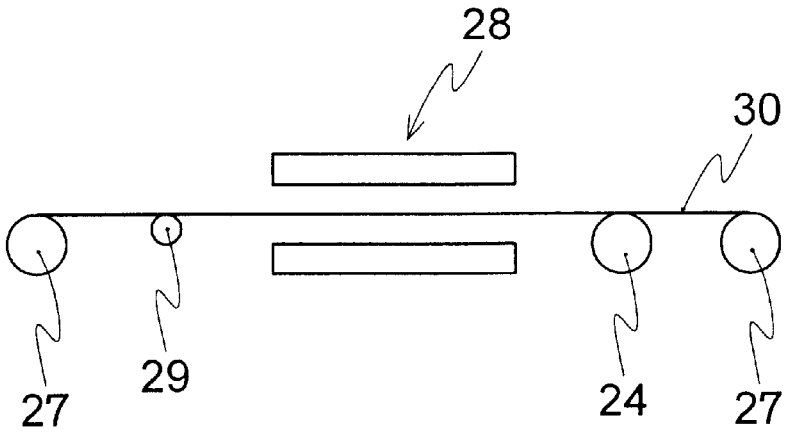
FIG. 3 is a schematic view of apparatus of the drawing step of the present invention.
Figure 4:
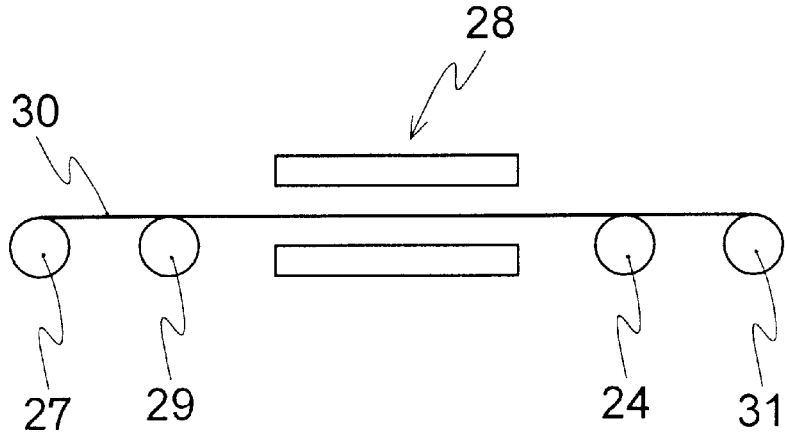
FIG. 4 is a schematic view of apparatus of the heat treating step of the present invention.

Each of FIGS. 2, 3 and 4 is a schematic view illustrating an example of apparatus used in the preparation process of the present invention.

FIG. 2 is a schematic view illustrating an extruder and hot water bath apparatus for crystallization. A thermoplastic polymer comprising polyhydroxyalkanoate is extruded from a melt-extruder 21 to form melted filament 23, and the melted filament 23 is transferred to hot water in a hot water bath 26. A cooling cylinder 22 provided below the outlet of the melt-extruder 21 is a cooling cylinder having a double structure, through which the extruded melted filament 23 is transferred. Refrigerant is circulated inside the double structure of the cooling cylinder 22 to cool the melted filament 23 passing through the cooling cylinder 22. A taken up roll 24 is located in the hot water bath 26, leading the melted filament into hot water but also taking up the melted filament. Another taken up roll 24 located at the outlet of the hot water bath 26 has a role of taking up pre-drawn filament 25 in hot water, but also helps to draw the pre-drawn filament 25 as the ratio of peripheral speeds between the taken up roll 24 and another taken up roll 24 located in the hot water bath 26 is controlled. The drawn filament 25 is then transferred to the drawing step by a feeding roll 27.

FIG. 3 is a schematic view illustrating apparatus of the drawing step. The pre-drawn filament 25 in FIG. 3 is transferred between heating plates 28 by the feeding roll 27 through the heating roll 29. Drawn filament 30 is fed by another feeding roll 27 through the taken up roll 24.

FIG. 4 is a schematic view illustrating apparatus of the heat treating step of drawn filament. The drawn filament 30 in FIG. 4 is transferred through a heating roll 29 and heated by heating plates 28. The drawn filament 30 is then taken up on a taken up roll 24 and rolled on a winding roll 31.

Example 1

P(3HB-CO-3HH) comprising 7% by mole of 3HH and 93% by mole of 3HB (weight average molecular weight:

300,000, melting point: 140° C., glass transition point: 0° C., the maximum crystallization temperature: 70° C.) was used for the fiber spinning experiment.

Pellets of the P(3HB-CO-3HH) polymer were fed to an extruder through a hopper. The polymer was melted in a melt-compression zone (C1) and a melting zone (C2), and extruded from a die (D) having a circular orifice. Temperatures of each zone was C1: 130° C., C2: 150° C. and D: 120° C.

When passed through a cooling cylinder made of a double-structure cylindrical tube, melted filament extruded from the die of the extruder was cooled by an ethylene glycol solution having a coagulation point of −20° C. which is circulated inside the double structure of the cooling cylinder. At this point, the temperature of the refrigerant and the length of the cooling cylinder were adjusted so that the surface temperature of the melted filament passing through the cooling cylinder becomes 0° C. Subsequently, the filament was transferred to the hot water bath kept to a water temperature of 40° C. and taken up on the taken up roll located at the outlet of the hot water bath through another taken up roll located in the hot water bath. According to this, the filament could be partially crystallized. The drawing ratio in this step was 1.5-fold. The obtained pre-drawn filament was one which was lowly drawn, exhibited rubber elasticity, and in addition, showed insufficient progress of crystallization and orientation of crystals. However, large sphaerite was unlikely to grow and the filament could be drawn again even if it was once rolled up.

The thus-obtained pre-drawn filament was then drawn 5-fold in the drawing step shown in FIG. 3. The drawing temperature at this stage was 70° C. The obtained drawn filament was then subjected to heat treating shown in FIG. 4 at 70° C. to prepare final filament as the biodegradable fiber of the present invention.

Properties of the thus-obtained filament are shown in Table 3.

TABLE 3

| | Ex. No. 1 |
|---|---|
| Tensile elastic modulus (GPa) | 1.33 |
| Elongation at break (%) | 53.4 |
| Tensile strength (MPa) | 221.1 |

Comparative Example 1

Fiber spinning was carried out in the same manner as in Example 1 except that melted filament was not rapidly cooled to at most the glass transition point at the exit of the die of the extruder. In this case, taking up of the filament in the hot water bath was difficult and end breakage occurred frequently.

Example 2

Fiber spinning was carried out in the same manner as in Example 1 except for adjusting the water temperature of the hot water bath to 120° C. In this case, though the pre-drawn filament which came out from the hot water bath 26 was slightly adhesive to the taken up roll, it was possible to roll up the drawn filament. There was no end breakage or impossible operation due to fusing.

Comparative Example 2

Fiber spinning was carried out in the same manner as in Example 2 except that the melted filament was not rapidly cooled to at most the glass transition point at the exit of the die of the extruder. In this case, the filament was drawn and broken as soon as taking up of the filament was carried out in the hot water bath, and the rolling up of the filament was impossible.

Example 3

Fiber spinning was carried out in the same manner as in Example 1 except for adjusting the drawing temperature to 120° C. In this case, though the drawn filament was slightly uneven in diameter, it was possible to obtain elastic drawn filament.

Comparative Example 3

Fiber spinning was carried out in the same manner as in Example 3 except that melted filament was not rapidly cooled to at most the glass transition point at the exit of the die of the extruder. In this case, the same trouble as that of Comparative Example 1 happened and drawing was impossible.

Examples 4 to 7

Pre-drawn filament was prepared in the same manner as in Example 1. Subsequently, the filament was drawn and rolled up as drawn filament in the same manner as in Example 1 except that the drawing ratio was 4-fold. Second drawing was carried out under the same conditions but at a drawing ratio of 1.5-, 2- and 3-fold, respectively, to obtain each drawn filament whose total drawing ratio is 6-, 8- and 12-fold. Properties of the thus obtained filaments are shown in Table 4. The drawn filament of Example 4 was drawn filament without second drawing. The drawn filament of Example 4 obtained by only first drawing at a drawing ratio of 4-fold had an elongation of 78%. This drawn filament was flexible fiber whose progress of crystallization and orientation was insufficient.

On the other hand, strong fiber was obtained in Example 7. That is, elastic modulus and tensile strength of the filament obtained in Example 7 having a total drawing ratio of 12-fold were increased to as high as 1.54 GPa and 276 MPa, respectively.

TABLE 4

| | Ex. No. 4 | Ex. No. 5 | Ex. No. 6 | Ex. No. 7 |
|---|---|---|---|---|
| Total drawn ratio | 4 | 6 | 8 | 12 |
| Tensile strength (MPa) | 175 | 230 | 235 | 276 |
| Elastic modulus (GPa) | 0.72 | 1.26 | 1.30 | 1.54 |
| Elongation (%) | 78 | 56 | 53 | 45 |

Example 8

The drawn filament obtained in Example 7 having a total drawing ratio of 12-fold was subjected to heat treating in the same manner as in Example 1 (tension: 15 MPa, treating time: 1 minute) except for changing the heating temperature to 80° C. to obtain final filament. Properties of the thus-obtained filament are shown in FIG. 5. Both elastic modulus and tensile strength were increased due to the heat treating, which means that stronger fiber was obtained.

TABLE 5

| | Ex. No. 7 before heat treating | Ex. No. 8 after heat treating |
|---|---|---|
| Tensile strength (MPa) | 276 | 306 |
| Elastic modulus (GPa) | 1.54 | 1.94 |
| Elongation (%) | 45 | 39 |

As described in detail, the present invention achieves the fiber spinning of thermoplastic polymers such as P(3HB-CO-3HH) which have low crystallization degree and crystallization speed, and enables to obtain biodegradable fibers having a wide variety of properties, including flexible fibers excellent in elasticity or high tension fibers by adjusting drawing ratio. The biodegradable fibers obtained by the process of the present invention can be used for a various purposes including knitted materials and textiles.

What is claimed is:

1. A process for producing a biodegradable fiber which comprises steps of:

preparing a melted filament by extruding a thermoplastic polymer comprising polyhydroxyalkanoate from a melt-extruder;

rapidly cooling the filament to at most the glass transition point of the thermoplastic polymer;

passing the filament through a hot water bath adjusted to a water temperature of at least the glass transition point; and drawing the same.

2. The process of claim 1, wherein the rapidly cooling step is a step in which the filament is rapidly cooled by passing the filament through a cooling cylinder provided below an outlet of the melt extruder to lower the temperature of at least the surface of the melted filament to at most the glass transition point.

3. The process of claim 1, wherein the polyhydroxyalkanoate is a copolymer containing at least 3-hydroxybutylate and 3-hydroxyhexanoate.

4. The process of claim 1, wherein the water temperature of the hot water bath is from at least the glass transition point to at most the maximum crystallization temperature of the thermoplastic polymer +20° C., and wherein the filament is partially crystallized by passing the filament through the water bath adjusted to the temperature.

5. The process of claim 1, wherein the temperature of the drawing step is in the range of the maximum crystallization temperature of the thermoplastic polymer −20° C. to the maximum crystallization temperature of the thermoplastic polymer +20° C.

6. The process of claim 1, wherein the drawing step is carried out at a drawing ratio of 2 to 8-fold.

7. The process of claim 1, wherein, after the drawing step, further drawing is carried out for 1 to 3 times under the same condition at a drawing ratio of 1.2 to 4-fold.

8. The process of claim 1, further comprising a heat treating step after the drawing step.

9. The process of claim 8, wherein the heat treating step is carried out in a temperature range of the maximum crystallization temperature of the thermoplastic polymer −20° C. to the maximum crystallization temperature of the thermoplastic polymer +20° C.

10. A biodegradable fiber obtained by the process of claim 1.

* * * * *